US009222379B2

(12) United States Patent
Ito et al.

(10) Patent No.: US 9,222,379 B2
(45) Date of Patent: Dec. 29, 2015

(54) ELECTRIC CONTROL DEVICE

(71) Applicant: DENSO CORPORATION, Kariya, Aichi-pref. (JP)

(72) Inventors: Atsushi Ito, Chiryu (JP); Ryozo Kayama, Kariya (JP); Shinichi Sugiura, Kariya (JP); Yasuyoshi Suzuki, Chiryu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/277,101

(22) Filed: May 14, 2014

(65) Prior Publication Data

US 2014/0352637 A1 Dec. 4, 2014

(30) Foreign Application Priority Data

Jun. 3, 2013 (JP) ..... 2013-116860

(51) Int. Cl.
*F01L 1/34* (2006.01)
*F01L 13/00* (2006.01)

(52) U.S. Cl.
CPC ..... *F01L 13/00* (2013.01); *F01L 13/0063* (2013.01); *F01L 2820/032* (2013.01)

(58) Field of Classification Search
CPC ..... F01L 13/00
USPC ..... 123/90.11, 90.16
See application file for complete search history.

(56) References Cited

U.S. PATENT DOCUMENTS

| | | | | |
|---|---|---|---|---|
| 4,539,951 | A | 9/1985 | Hara et al. | |
| 5,873,335 | A * | 2/1999 | Wright et al. | 123/90.11 |
| 7,568,457 | B2 * | 8/2009 | Kusaka et al. | 123/90.16 |

FOREIGN PATENT DOCUMENTS

| | | | |
|---|---|---|---|
| JP | 61-023814 | A | 2/1986 |
| JP | 2006-144593 | A | 6/2006 |

* cited by examiner

*Primary Examiner* — Zelalem Eshete
(74) *Attorney, Agent, or Firm* — Posz Law Group, PLC

(57) ABSTRACT

An electric control device includes: a cam having a variable distance between an outer periphery and a center; a control shaft having one end, which contacts the outer periphery of the cam, and displaceable according to a rotation of the cam to adjust a valve lift amount; a motor rotating the cam; an angle detector detecting a rotation angle of the cam; and a controller. The cam includes multiple steps arranged on the outer periphery. The controller controls the rotation of the cam through the motor to match a detection angle of the angle detector with a target angle corresponding to a target valve lift amount. The controller stops rotating the cam through the motor when a difference between the detection angle and the target angle exceeds a first threshold, and the target angle corresponds to one of the steps.

10 Claims, 5 Drawing Sheets

ELECTRIC CONTROL DEVICE

CROSS REFERENCE TO RELATED APPLICATION

This application is based on Japanese Patent Application No. 2013-416860 filed on Jun. 3, 2013, the disclosure of which is incorporated herein by reference.

TECHNICAL FIELD

The present disclosure relates to an electric control device for controlling a valve lift amount adjusting unit, which adjusts a valve lift amount based on a displacement amount of a control shaft that is displaceable in an axial direction according to a rotation of a cam.

BACKGROUND

In an internal combustion engine mounted on a vehicle, it is known that a valve lift amount of an inlet valve and/or an outlet valve are variably controlled in order to improve an output power and/or a fuel consumption. For example, JP-A-2006-144593 teaches a technique for adjusting a valve lift amount by displacing a control shaft as a control axis in an axial direction according to a rotation of a cam. In this case, the cam is rotated and driven by a driving unit such as a motor.

In the above case, in order to maintain the valve lift amount to be a certain amount, it is necessary to keep a rotation angle of the cam within a predetermined angle range. In order to keep the rotation angle of the cam within the predetermined angle range, it is necessary to continue energizing the motor, i.e., to keep flowing current through the motor. In this case, the electric power consumption at a driving circuit for driving the motor increases. Further, when the electric power consumption increases, a running cost and a manufacturing cost of heat radiation system in the electric control device for controlling the driving circuit of the motor and in the driving circuit of the motor. Further, minimizing the dimensions of the electric control device may be difficult.

SUMMARY

It is an object of the present disclosure to provide an electric control device having an electric power consumption at a driving circuit of a motor. The electric power consumption of the electric control device is reduced, and the motor drives a cam.

According to an aspect of the present disclosure, an electric control device for controlling a valve lift amount adjusting system includes: a cam having an outer periphery and a center, wherein a distance between the outer periphery and the center varies; a control shaft having one end, which contacts the outer periphery of the cam, the control shaft being displaceable in an axial direction of the control shaft according to a rotation of the cam so that the control shaft adjusts a valve lift amount based on a displacement amount of the control shaft; a motor that applies a rotation force to the cam so that the cam rotates; an angle detector that detects a rotation angle of the cam; and a controller that controls the motor. The cam includes a plurality of steps, each of which is arranged on the outer periphery. Each step is opposed to the one end of the control shaft when the step of the cam contacts the control shaft. The controller controls the rotation of the cam through the motor to match a detection angle of the angle detector with a target angle of the cam. The target angle of the cam corresponds to a target valve lift amount. The controller stops rotating the cam through the motor when a difference between the detection angle and the target angle exceeds a first threshold under a condition that the target angle corresponds to one of the steps.

The above electric control device controls the rotation of the cam by feedback so as to match the valve lift amount with a target valve lift amount. In this case, in order to maintain the valve lift amount to be a predetermined amount, it is necessary to continue driving the cam through the motor. When the control shaft contacts the outer periphery of the cam, a reaction force of the contact generates a force for rotating the cam. In view of this difficulty, multiple steps facing the one end of the control shaft are arranged on the outer periphery of the cam when the control shaft contacts the outer periphery of the cam. When the control shaft contacts one of the steps, the reaction force of the contact between the one end and the one of steps does not generate a force for rotating the cam. Thus, the operation of the cam through the motor can be interrupted. Accordingly, when the target angle determined by the target valve lift amount corresponds to the one of steps, the electric control device can maintain the valve lift amount to be the target valve lift amount without driving the cam through the motor.

Accordingly, when the control shaft contacts the one of steps, the electric control device stops rotating the cam through the motor. The electric power consumption for the driving circuit of the motor is reduced because of the stoppage of the motor drive.

Further, in the above electric control device, when the target angle corresponds to the one of steps, and the difference exceeds the first threshold, the controller stops rotating the cam through the motor. Specifically, when the target angle corresponds to the one of steps, and the overshooting state that the rotation angle of the cam exceeds the target angle occurs, the controller stops rotating the cam through the motor. When the controller stops rotating the cam through the motor, the control shaft contacts a no-step portion other than the steps on the outer periphery of the cam. Accordingly, the contact between the outer periphery of the cam and the control shaft generates a force for rotating the cam. This force applies to the cam so that the cam rotates toward the target angle. Thus, the electric power consumption at the time when the control shaft does not contact the one of steps is also reduced. In the present disclosure, the electric power consumption at the driving circuit for the motor, which drives the cam, is reduced. Thus, the cost for providing the heat radiation from the driving circuit is limited to be small. The dimensions of a whole of the electric control device are minimized.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

An example embodiment of the present disclosure will be explained with reference to drawings.

Figure 1:
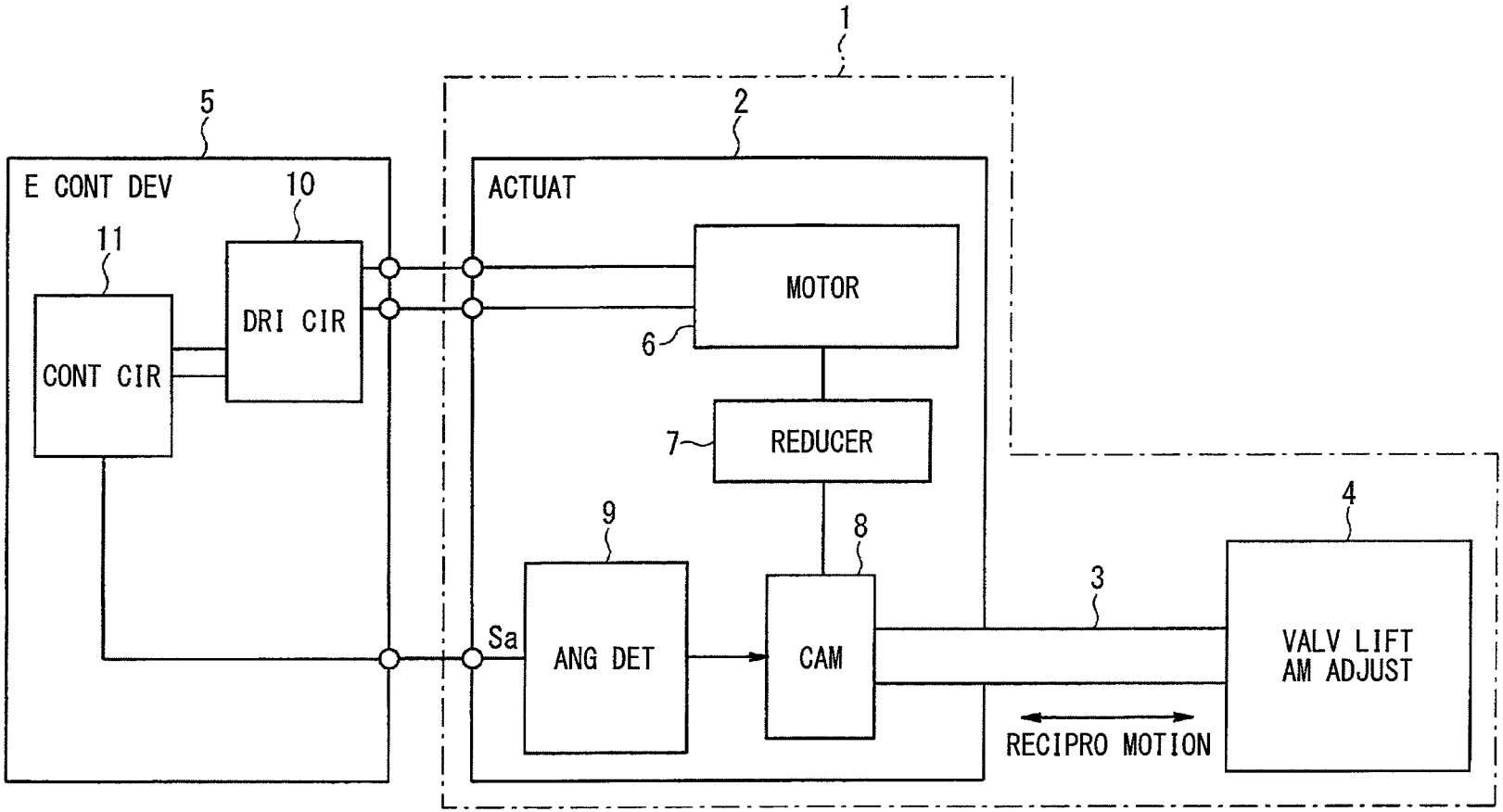
FIG. 1 is a diagram showing an electric control device and a valve lift amount adjusting unit.

A valve lift amount adjusting unit 1 shown in FIG. 1 adjusts a valve lift amount of an inlet valve (not shown) of an internal combustion engine mounted on a vehicle such as an automotive vehicle. The valve lift amount adjusting unit 1 includes an actuator 2, a control shaft 3 and a valve lift amount adjusting system 4. The operation of the valve lift amount adjusting unit 1 is controlled by an electric control device 5.

The actuator 2 includes a motor 6, a reducer 7, a cam 8 and an angle detector 9. The motor 6 is a direct current motor, for example. The motor 6 is driven by being supplied an electric power from the electric control device 5. The rotation shaft of the motor 6 is coupled with a rotation shaft of the cam 8 via the reducer 7. The reducer 7 transmits the rotation of the motor 6 to the cam 8 after the reducer 7 reduces the rotation of the motor 6. The cam 8 is rotated by the rotation force applied from the motor via the reducer 7 to the cam 8.

The angle detector 9 includes a rotation angle sensor for detecting the rotation angle of the cam 8. The angle detector 9 outputs an angle detection signal Sa indicative of a detection value (i.e., a detection angle) of the rotation angle of the cam 8 to the electric control device 5. The control shaft 3 is displaceable in the axial direction according to the rotation of the cam 8, so that the control shaft 3 is reciprocated by the rotation of the cam 8. The valve lift amount adjusting system 4 adjusts the valve lift amount of the inlet valve (not shown) in accordance with the displacement amount of the control shaft 3 in the axial direction.

The electric control device 5 is an engine control unit for controlling an internal combustion engine. The electric control device 5 includes a driving circuit 10 and a control circuit 11. The driving circuit 10 includes an IC for driving the motor having a H bridge circuit. The driving circuit 10 supplies the electric power to the motor 6 based on a driving instruction from the control circuit 11. Thus, the driving circuit 10 energizes the motor 6 to rotate and drive the motor 6.

The control circuit 11 includes a microcomputer. The control circuit 11 obtains a detection angle θd of the cam 8 based on the angle detection signal Sa from the angle detector 9. The control circuit 11 determines a target angle θr of the cam 8 according to the target amount of the valve lift amount. The control circuit 11 controls the driving of the motor 6 via the driving circuit 10 so as to coincide the detection angle θd of the cam 8 with the target angle θr. In this case, the cam 8 is controlled to match the valve lift amount with the target valve lift amount.

Then, the construction of the control shaft 3 and the cam 8 will be explained with reference to FIGS. 2A to 3B. The control shaft 3 is displaceable in the axial direction (Le., a right left direction of the drawings). The control shaft 3 is pressed from the valve lift amount adjusting system side to the cam side (i.e., from the right side to the left side in the drawings) so that the one end of the shaft 3 contacts the outer periphery of the cam 8. Here, a system for pressing the shaft 3 may be a spring.

The cam 8 has an outer peripheral surface and a rotation center 21 in such a manner that a distance between the outer peripheral surface and the rotation center 21 is variable. The outer periphery of the cam 8 includes three steps 22*a*-22*c*, each of which has a slope facing a one end surface of the control shaft 3 when the cam 8 contacts the control shaft 3. Specifically, each step 22*a*-22*c* has a shape without rounding. The outer periphery of the cam 8 other than the steps 22*a*-22*c* includes a no-step portion 23 having a circular arc shape with the rotation center 21 as a center of the arc. Thus, each step 22*a*-22*c* has the slope different from the no-step portion 23.

The length of each step 22*a*-22*c* is slightly longer than the length of the one end surface of the control shaft 3 in a radial direction. The length of each step 22*a*-22*c* is disposed in an angle range of 10 degrees around the rotation center 21. In FIGS. 2A to 3B, each step 22*a*-22*c* is shown by a thick line so as to emphasize the step 22*a*-22*c*, compared with the no-step portion 23.

Under a condition that the control shaft 3 contact the step 22*a*-22*c*, the force for pressing the outer periphery of the cam 8 with the control shaft 3 is balanced with the reaction force of the cam 8. The rotation angle of the cam 8 is maintained without rotating the cam 8. On the other hand, under a condition that the control shaft 3 contacts the no-step portion 23, the force of the control shaft 3 for pressing the outer periphery of the cam 8 provides the force for rotating the cam 8 (which is a force to rotate the cam 8 in a left rotation manner).

Figure 2A:
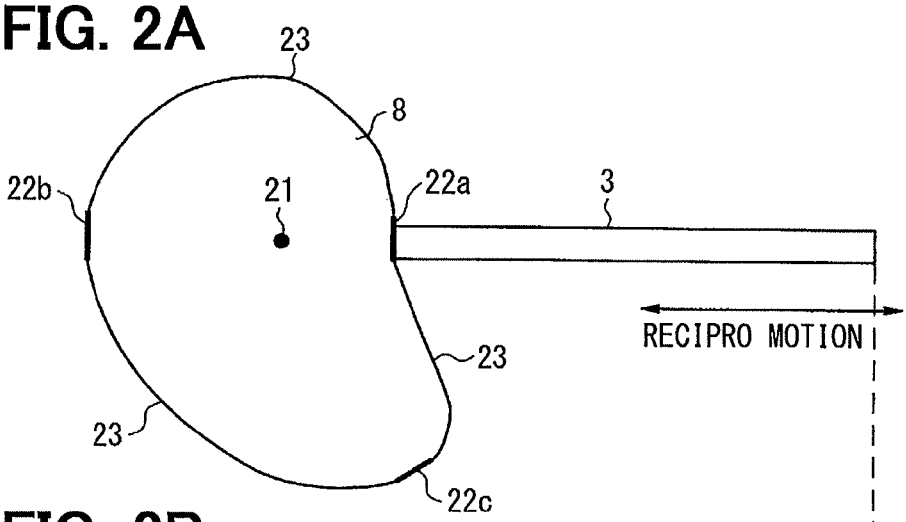
FIGS. 2A to 2C are diagrams showing a control shaft and a cam when the control shaft contacts a step portion.
Figure 2B:
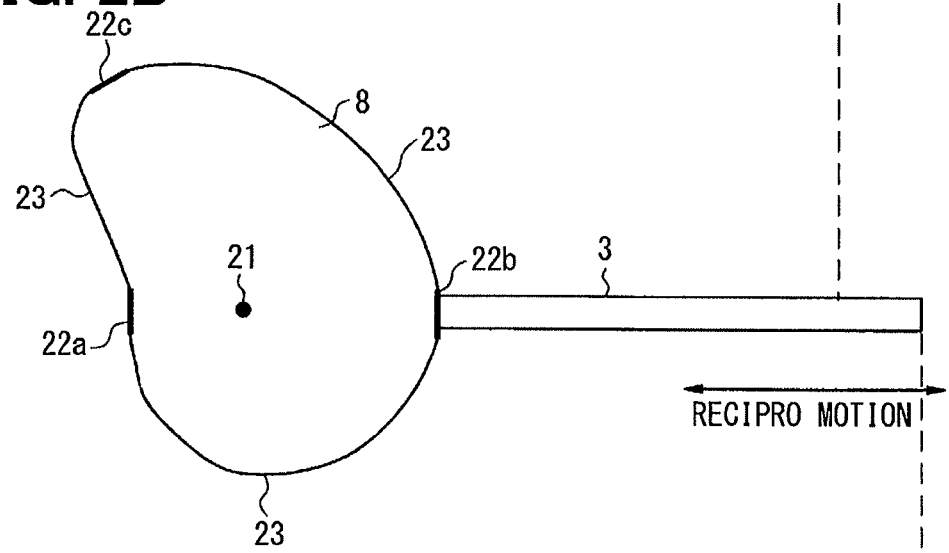
Figure 2C:
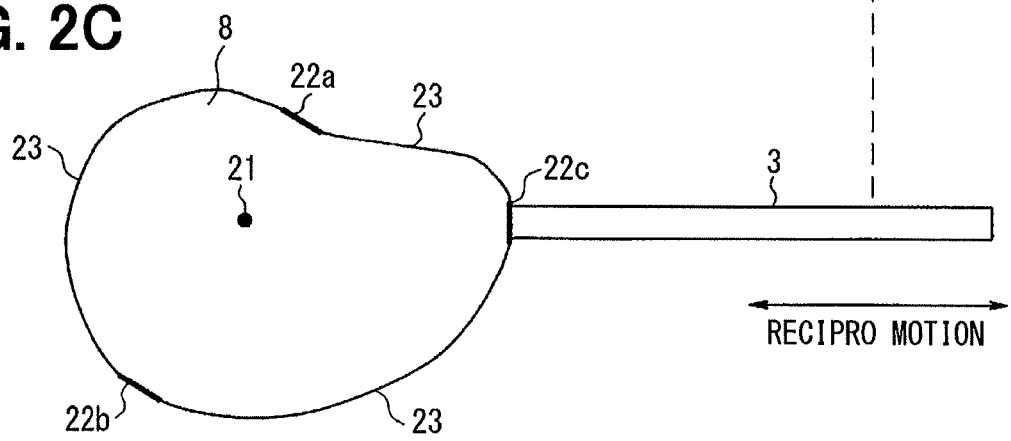

The cam 8 is rotatable. However, the rotation range of the cam 8 is limited by a stopper (not shown). Specifically, the rotation range of the cam 8 is set in a range between a state that the control shaft 3 contacts the step 22*a* and a state that the control shaft 3 contacts the step 22*c*. The range includes a state that the control shaft 3 contacts the step 22*b*. The state that the control shaft 3 contacts the step 22*a* is shown in FIG. 2A, the state that the control shaft 3 contacts the step 22*c* is shown in FIG. 2C, and the state that the control shaft 3 contacts the step 22*b* is shown in FIG. 2B.

The rotation angle of the cam 8 is controlled by the control circuit 11 in the electric control device 5. The target angle θr is set to one of angles corresponding to three steps 22*a*-22*c*. Specifically, in the valve lift amount adjusting unit 1 in the present embodiment, the valve lift amount is adjusted and controlled to be one of three steps.

Figure 4:
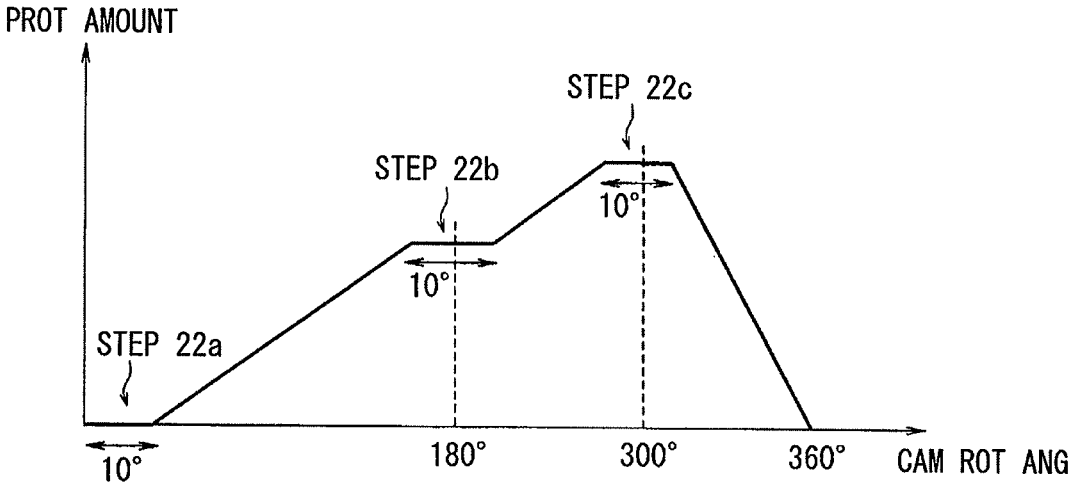
FIG. 4 is a graph showing a relationship between a protrusion amount of the control shaft and a rotation angle of the cam.

As shown in FIG. 4, the displacement of the control shaft 3 in the axial direction (defined as a protrusion amount) increases in an order from a state that the control shaft 3 contacts the step 22*a*, a state that the control shaft 3 contacts the step 22*b*, and a state that the control shaft 3 contacts the step 22*c*. Accordingly, the valve shift amount in the state that the control shaft 3 contacts the step 22*a* is the smallest, and the valve shift amount in the state that the control shaft 3 contacts the step 22*c* is the largest. Here, the protrusion amount, i.e., the valve lift amount, is changed with a predetermined increment (i.e., a predetermined slope) when one state is changed to another state.

Next, the variable control operation of the valve lift amount executed by the control circuit 11 of the electric control device 5 will be explained with reference to FIG. 5. At step S1, the driving circuit 10 energizes the motor 6, so that the motor 6 is driven. At step S2, the detection angle θd of the cam 8 is obtained from the angle detection signal Sa input from the angle detector 9.

At step S3, the control circuit 11 determines whether a difference between the detection angle θd and the target angle θr (i.e., a value obtained by subtracting the target angle θr from the detection angle θd) exceeds the first threshold such as zero degree. When the difference is equal to or smaller than the first threshold, the determination of step S3 is "NO." Then, it returns to step S1. When the difference is larger than the first threshold, the determination of step S3 is "YES." It goes to step S4. At step S4, the control circuit 11 stops energizing the motor 6, so that the operation of the motor 6 is interrupted. Specifically, until the detection angle θd exceeds the target angle θr, the control circuit 11 energizes the motor 6 continuously so as to approach the rotation angle of the cam 8 to the target angle θr. When the detection angle θd exceeds the target angle θr, the control circuit 11 stops energizing the motor 6, and therefore, the operation of the cam 8 is stopped.

After the drive of the motor 6 is stopped at step S4, it goes to step S5. At step S5, the detection angle θd is obtained again. At step S6, the control circuit 11 determines whether the difference between the detection angle θd and the target angle θr (i.e., the value obtained by subtracting the target angle θr from the detection angle θd) falls below the second threshold such as minus five degree (−5°). When the difference is smaller than the second threshold, the determination of step S6 is "YES." Then, it goes to step S7. At step S7, the target angle θr is corrected according to the following equation No. 1. Here, the current target angle is defined as θr'. The new target angle, which is corrected, is defined as θr. The correction value is defined as α.

$$\theta r=\theta r'+\alpha \quad \text{(Equation No. 1)}$$

After step S7, it returns to step S1. Specifically, when the difference is smaller than the second threshold, the driving operation of the cam 8 is executed based on the new target angle, which is calculated by adding the correction value α such as +5° to the current target angle.

When the difference is equal to or larger than the second threshold, the determination of step S6 is "NO." It goes to step S8. At step S8, the control circuit 11 determines whether the change of the detection angle θd is smaller than a predetermined determination value, i.e., whether the detection angle θd is changed, When the detection angle θd is substantially constant, the determination at step S8 is "NO." Then, it goes to step S9. When the detection angle θd is changed, the determination at step S8 is "YES." Then, it goes to step S6.

At step S9, based on the detection angle θd at that moment, the target angle θr is corrected, i.e., the target angle is learnt. Specifically, the target angle θr corresponding to a target valve lift amount at that moment is replaced to the detection angle θd at that moment.

In the above described embodiment, the following effects and advantages are obtained.

In the present embodiment, the target angle θr of the cam 8 is set to one of target angles corresponding to three steps 22*a*-22*c*. When the control shaft 3 contacts one of the steps 22*a*-22*c*, the operation of the cam 8 or the motor 6 is stopped. Thus, in the present embodiment, when the rotation angle of the cam 8 reaches the target angle, the energization to the motor 6 is stopped. Thus, the electric power consumption of the driving circuit 10 for driving the motor 6 is reduced.

In the present embodiment, the rotation angle of the cam 8 is controlled according to the following points, which are different from an ordinary feedback control method. Specifically, when the state of the control shaft 3 is changed to one state among the state that the control shaft 3 contacts the no-step portion 23 and the states that the control shaft 3 contacts the steps 22*a*-22*c*, the load of the motor 6 corresponding to the rotation force applied to the cam 8 is largely changed. Accordingly, in the ordinary feedback control method, an overshooting state that the detection angle θd of the cam 8 exceeds the target angle θr and an undershooting state that the detection angle θd of the cam 8 falls below the target angle θr are repeated. As a result, a time interval for coinciding the rotation angle of the cam 8 with the target angle θr (i.e., convergence time for converging the rotation angle of the cam 8 to the target angle θr) is lengthened. In this case, the electric power consumption of the driving circuit 10 for the motor 6 increases because of the lengthened convergence time.

On the other hand, in the control method according to the present embodiment, when the overshooting state that the rotation angle of the cam 8 exceeds the target angle θr occurs, the operation of the motor 6 is interrupted. Thus, when the operation of the motor 6 is interrupted, the rotation angle of the cam 8 is slightly larger than the target angle θr. In this case, the control shaft 3 contacts the no-step portion 23. Accordingly, the force of the control shaft 3 for pressing the outer periphery of the cam 8 generates the rotation force of the cam 8, which corresponds to a force for rotating the cam 8 in the left rotation manner. The cam 8 rotates toward the target angle θr according to the rotation force.

In the above control method, even when the energization to the motor 6 is not executed after the rotation angle θd of the cam 8 exceeds the target angle θr once, the rotation angle of the cam 8 converges to the target angle θr naturally (i.e., automatically). Accordingly, the energization period of the motor 6 until the rotation angel of the cam 8 converges to the target angle θr is limited to be short. The electric power consumption of the driving circuit 10 for the motor 6 is reduced because of the shortened energization period. Thus, in the present embodiment, the electric power consumption at the driving circuit 10 for the motor 6 that drives the cam 8 is reduced. The cost for providing the heat radiation from the driving circuit 10 for the motor 6 is limited to be small. The dimensions of a whole of the electric control device 5 are minimized.

Figure 3A:
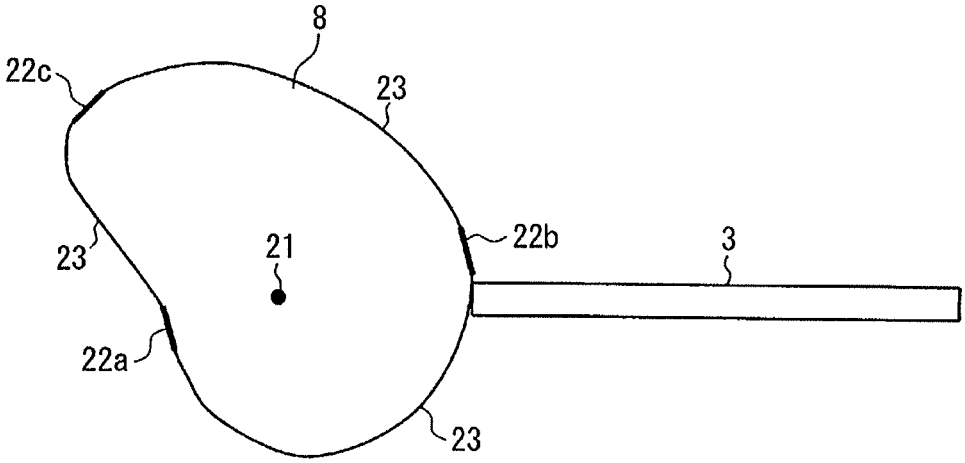
FIGS. 3A and 3B are diagrams showing the control shaft and the cam when the control shaft contacts the step portion.
Figure 3B:
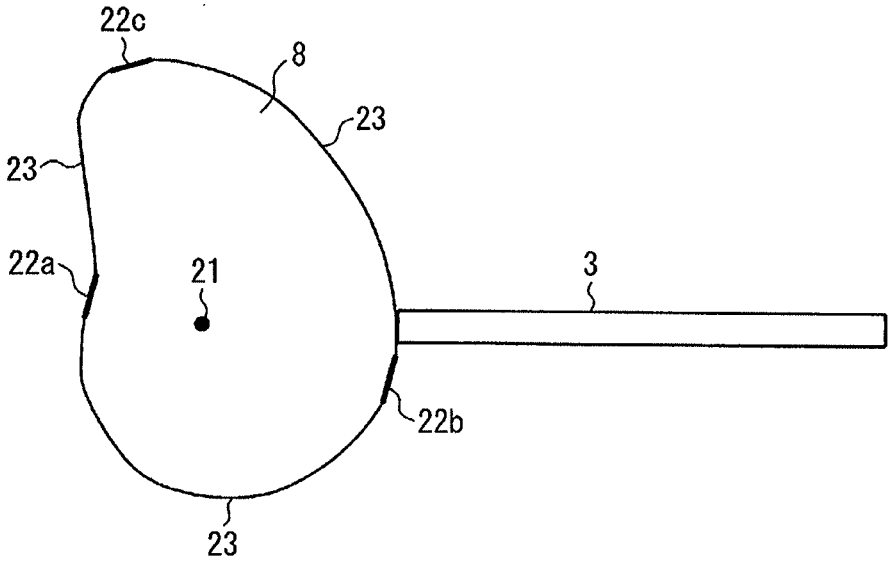

When the above control method is performed, the detection accuracy of the rotation angle of the cam 8 may be low. Specifically, the detection accuracy of the angle detector 9 may be low, and therefore, the detection angle θd is larger than an actual rotation angle. In this case, although the actual rotation angle is smaller than the target angle θr, the operation of the motor 6 may be stopped. As shown in FIG. 3A, the control shaft 3 contacts the no-step portion 23, which is disposed before the step 22*b* corresponding to the target angle θr. Accordingly, the force for rotating the cam 8 is generated so that the cam 8 moves away from the target angle θr.

In the present embodiment, after the operation of the motor 6 is stopped since the overshooting state arises, if the undershooting state having a magnitude equal to or larger than predetermined magnitude arises, the determination of step S6 is "YES." In this case, the operation of the motor 6 restarts. Thus, the cam 8 starts to rotate toward the target angle θr again. Here, even when the operation of the motor 6 restarts, the detection error may be generated. In this case, the above difficulty may arise. Thus, in the present embodiment, when the operation of the motor 6 restarts, the drive of the motor 6 is controlled based on the new target angle, which is calculated by adding the predetermined correction value α to the current target angle. Thus, even if the detection error arises, the occurrence of the above difficulty is limited.

When the rotation angle of the cam 8 converges to the target angle θr, i.e., when the determination at step S8 is "NO," the target angle θr corresponding to the target valve lift amount at the that moment is replaced to the detection angle θd at that moment. In this case, the target angle θr corresponding to one of the steps 22*a*-22*c* is appropriately corrected to a value, which is suitable for the situation at that moment every time the drive of the cam 8 is controlled (i.e., adjusted). Thus, the accuracy of the control of the rotation angle of the cam 8 and the accuracy of the variable control of the valve lift amount are improved.

The present disclosure is not limited to the above embodiment, and the present disclosure may be modified or expanded as follows.

If step S7 for correcting the target angle θr is repeatedly executed multiple times, i.e., if steps from step S1 to step S7 are repeatedly executed multiple times, anomaly or difficulty may be generated in a system, in addition to a cause of the detection error of the angle detector 9. In this case, the rotation angle of the cam 8 may not converge to the target angle θr. In view of these points, the control method at the control circuit 11 shown in FIG. 5 may include a step for counting the number of times that the determination at step S6 is "YES" and a step for determining whether the number of times exceeds a predetermined number of times, a step for determining that the anomaly of the system occurs when the number of times exceeds the predetermined number of times, and a step for interrupting following steps when the anomaly of the system occurs. In this case, since the control method at the control circuit 11 includes the above described additional steps, the process at the control circuit 11 is interrupted when the anomaly of the system occurs. Accordingly, the system prevents from providing the difficulty that the process continues repeatedly for a long time since the rotation angle of the cam 8 does not converge the target angle θr.

Figure 5:
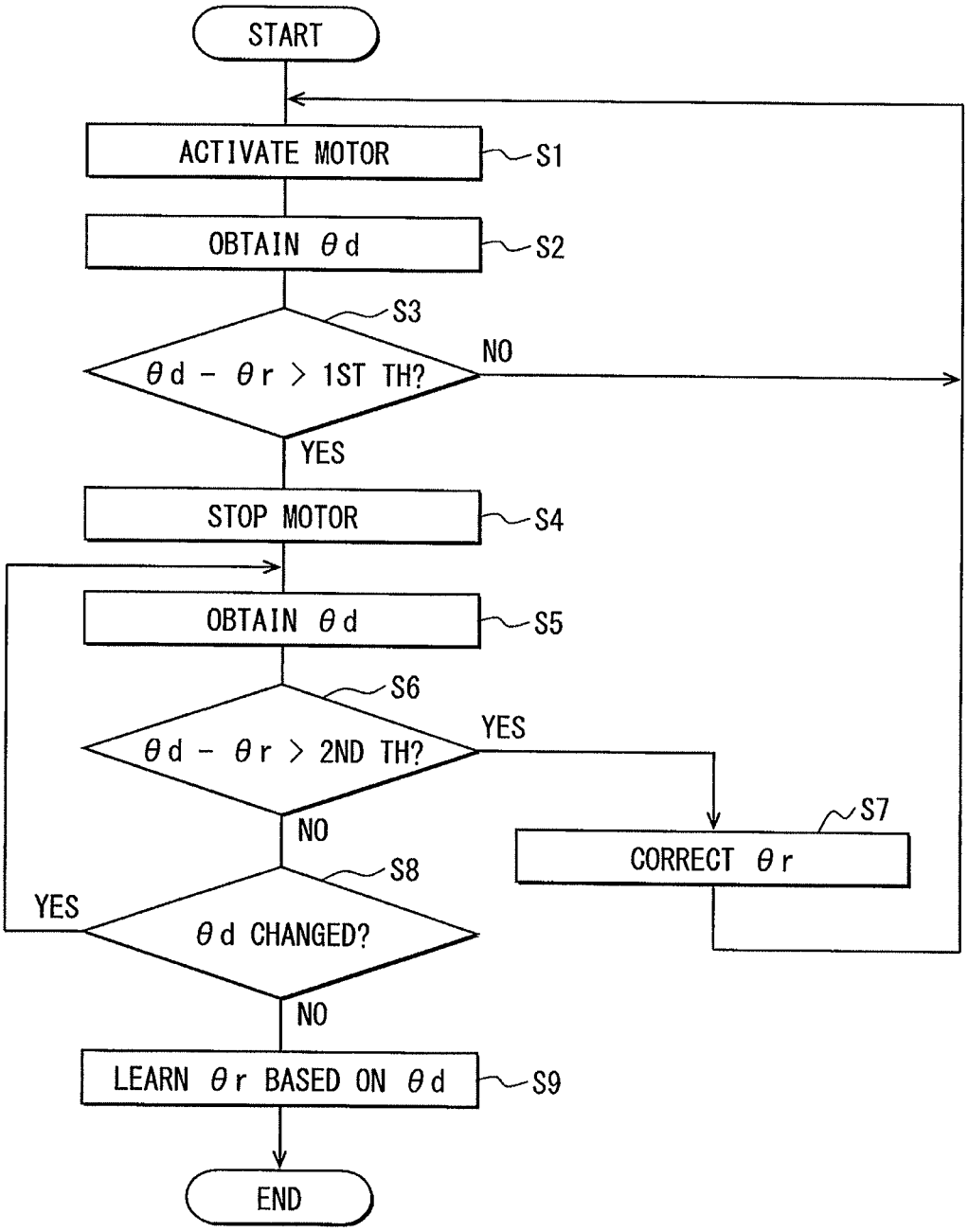
FIG. 5 is a flowchart showing a driving control of the cam in the electric control device.

Steps S5 to S7 of the process in FIG. 5 may be removed when the detection error of the angle detector 9 is negligibly small. Steps S8 and S9 in FIG. 5 may be removed when the control accuracy of the rotation angle of the cam 8 is sufficiently high.

In the present embodiment, the angle detector 9 directly detects the rotation angle of the cam 8. Alternatively, the angle detector 9 may detect the rotation angle of the cam 8 indirectly based on the rotation angle of the motor 6, which is detected by the angle detector 9 or the like.

The motor 6 may be a direct current motor. Alternatively, the motor 6 may be any kind of the motor as long as the motor 6 applies the rotation force to the cam 8.

The cam 8 may include multiple steps on the outer periphery of the cam 8. The number of steps in the cam 8 may be appropriately set in accordance with the adjustment steps of the valve lift amount.

It is noted that a flowchart or the processing of the flowchart in the present application includes sections (also referred to as steps), each of which is represented, for instance, as S100. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An electric control device for controlling a valve lift amount adjusting system comprising:

a cam having an outer periphery and a center, wherein a distance between the outer periphery and the center varies;

a control shaft having one end, which contacts the outer periphery of the cam, the control shaft being displaceable in an axial direction of the control shaft according to a rotation of the cam so that the control shaft adjusts a valve lift amount based on a displacement amount of the control shaft;

a motor that applies a rotation force to the cam so that the cam rotates;

an angle detector that detects a rotation angle of the cam; and a controller that controls the motor, wherein the cam includes a plurality of steps, each of which is arranged on the outer periphery and has a flattened shape, wherein each step is opposed to the one end of the control shaft when the step of the cam contacts the control shaft, wherein the controller controls the rotation of the cam through the motor to match a detection angle of the angle detector with a target angle of the cam, wherein the target angle of the cam corresponds to a target valve lift amount, and wherein the controller stops rotating the cam through the motor when a difference between the detection angle and the target angle exceeds a first threshold under a condition that the target angle corresponds to one of the steps.

2. The electric control device according to claim 1, wherein the difference between the detection angle and the target angle is obtained by subtracting the target angle from the detection angle.

3. The electric control device according to claim 1, wherein the controller restarts rotating the cam through the motor when the difference falls below a second threshold after the difference exceeds the first threshold, and the controller stops rotating the cam through the motor.

4. The electric control device according to claim 3, wherein the controller controls the rotation of the cam through the motor based on a new target angle, which is prepared by adding a predetermined correction value to the target angle, when the controller restarts rotating the cam through the motor.

5. The electric control device according to claim 1, wherein the controller corrects the target angle of the cam corresponding to the one of the steps according to the detection angle when a change of the detection angle is smaller than a predetermined threshold after the controller stops rotating the cam through the motor under a condition that the target angle corresponds to one of the steps.

6. An electric control device for controlling a valve lift amount adjusting system comprising:

a cam having a center and an outer periphery and a center, wherein a distance between the outer periphery and the center varies, and the outer periphery of the cam includes a plurality of steps;

a control shaft having one end in contact with the outer periphery of the cam, the control shaft being displaceable in an axial direction of the control shaft according to a rotation of the cam, a displacement amount of the control shaft by the cam adjusting a valve lift amount, and at each step the displacement amount of the control shaft is constant over a predetermined rotation angle of the cam;

a motor rotating the cam;

an angle detector detecting a rotation angle of the cam, and the displacement amount of the control shaft;

a controller controlling the motor, wherein the outer periphery of the cam is maintained in contact with the one end of the control shaft, and each step has a surface shape matching the surface shape of the one end of the control shaft when the step of the cam contacts the control shaft, the controller controls the rotation of the cam through the motor to match a detection angle of the angle detector with a target angle of the cam, the target angle of the cam corresponds to a target valve lift amount, and the controller stops rotating the cam through the motor when a difference between the detection angle and the target angle exceeds a first threshold under a condition that the target angle corresponds to one of the steps.

7. The electric control device according to claim 6, wherein the difference between the detection angle and the target angle is obtained by subtracting the target angle from the detection angle.

8. The electric control device according to claim 6, wherein the controller restarts rotating the cam through the motor when the difference falls below a second threshold after the difference exceeds the first threshold, and the controller stops rotating the cam through the motor.

9. The electric control device according to claim 8, wherein the controller controls the rotation of the cam through the motor based on a new target angle, which is prepared by adding a predetermined correction value to the target angle, when the controller restarts rotating the cam through the motor.

10. The electric control device according to claim 6, wherein the controller corrects the target angle of the cam corresponding to one of the steps according to the detection angle when a change of the detection angle is smaller than a predetermined threshold after the controller stops rotating the cam through the motor under a condition that the target angle corresponds to one of the steps.

* * * * *